United States Patent [19]

Maguire, Jr. et al.

[11] 4,164,009

[45] Aug. 7, 1979

[54] LIGHT FIXTURE

[75] Inventors: Justin M. Maguire, Jr., Cleveland Heights; Thomas M. Edwards, Broadview Heights, both of Ohio

[73] Assignee: Hauserman, Inc., Cleveland, Ohio

[21] Appl. No.: 782,991

[22] Filed: Mar. 30, 1977

[51] Int. Cl.[2] ..... F21V 33/00; F21S 3/02; F21V 21/00

[52] U.S. Cl. ..... 362/127; 362/226; 362/371; 362/432

[58] Field of Search ..... 362/97, 125, 127, 226, 362/217, 220, 368, 371, 418, 419, 427, 432, 145, 388, 396, 430, 457; 52/36

[56] References Cited

U.S. PATENT DOCUMENTS

| | | | |
|---|---|---|---|
| 1,548,238 | 8/1925 | Adams | 362/432 |
| 1,646,807 | 10/1927 | Benjamin | 362/432 |
| 2,166,394 | 7/1939 | Crossley | 362/371 |
| 2,362,148 | 11/1944 | Naysmith | 362/220 X |
| 3,108,751 | 10/1963 | Rodmaker et al. | 362/427 |
| 3,239,184 | 3/1966 | Kirkeby | 362/419 |
| 3,319,060 | 5/1967 | Bartley | 362/432 |
| 3,543,016 | 11/1970 | Jones | 362/371 |
| 3,886,698 | 6/1975 | Raith et al. | 52/36 |
| 3,963,913 | 6/1976 | Donovan et al. | 362/127 |

*Primary Examiner*—William M. Shoop
*Assistant Examiner*—Peter S. Wong
*Attorney, Agent, or Firm*—Maky, Renner, Otto & Boisselle

[57] ABSTRACT

A light fixture for horizontal or wall task surfaces for office and like interiors adapted to be used with an ambient light system which fixture utilizes a plain rectangular elongated housing for a fluorescent lamp with simplified end brackets which permit the fixture to be mounted directly or indirectly on screens or partitions at any desired elevation, and providing angular adjustment. Direct glare is avoided and veiling reflections reduced by angular selection, lens selection, and recessing the lens within the housing. The adjustment brackets provide precise angular incremental adjustment but are designed to slip if excessive force is exerted on the fixture to avoid damage to the fixture, partition, or screen.

21 Claims, 8 Drawing Figures

Fig. 4
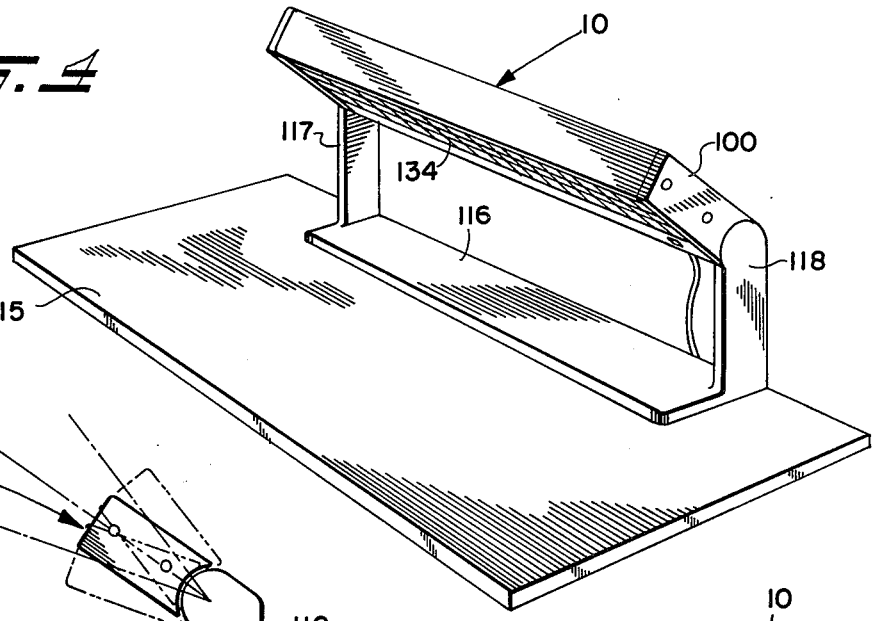
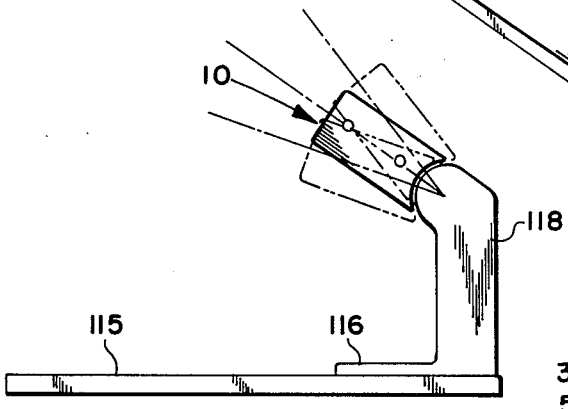
Fig. 5
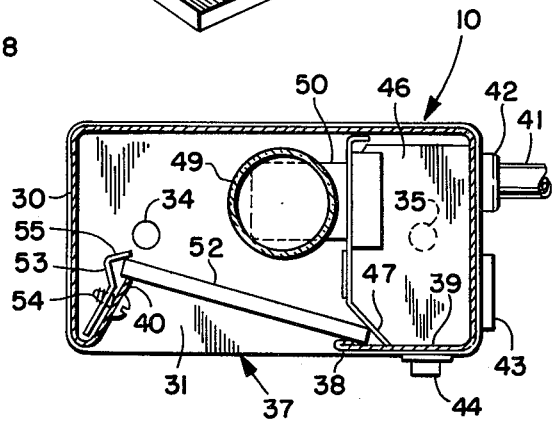
Fig. 7
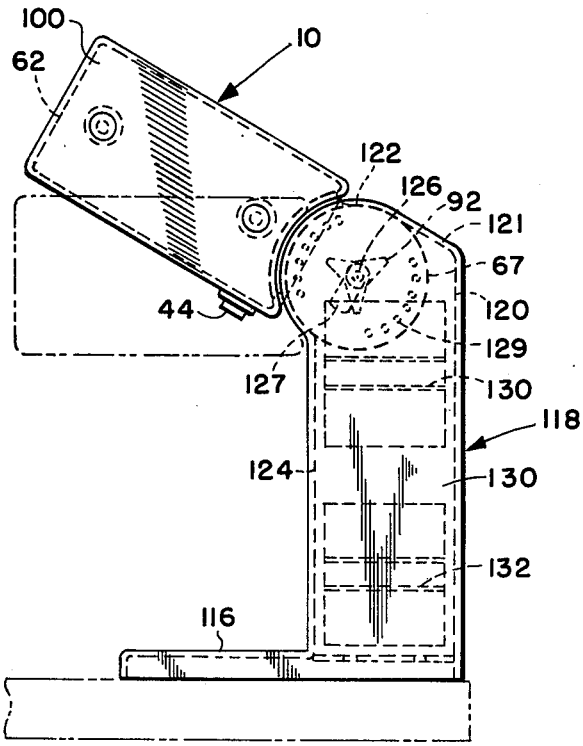
Fig. 6
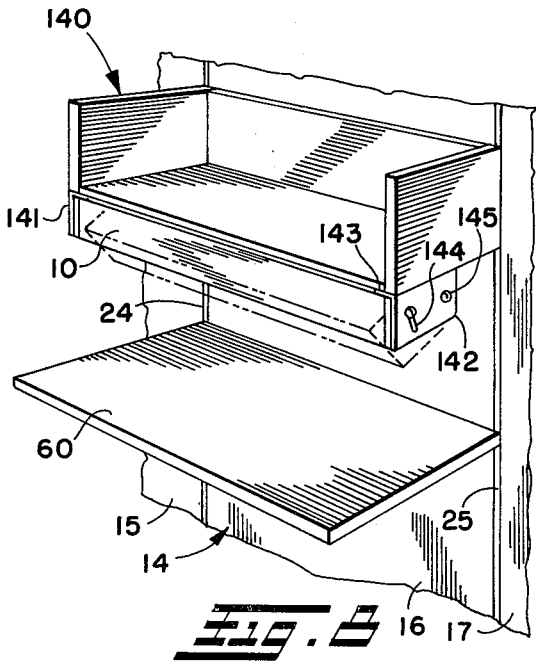
Fig. 8

LIGHT FIXTURE

This invention relates generally as indicated to a light fixture, and more particularly to a light fixture for use with modern office interior partitions or screens.

Modern office interiors utilize highly flexible partitions or screens, the panels of which include at their edges vertical rows of slots for hanging or supporting accessories. Such partition systems may be seen in Raith et al U.S. Pat. No. 3,886,698.

Office interiors are generally illuminated by fluorescent ceiling light fixtures which consume an inordinate amount of energy. More recent developments utilize high intensity discharge (HID) lamps supported on free-standing units or on partitions or screens. Such high intensity discharge lamps consume considerably less energy and provide a comfortable ambient level of illumination in an office interior. Such ambient light system may be seen in the copending application of Justin M. Maguire, Jr. entitled "Modular Interior Lighting Systems and Fixture Therefor," Ser. No. 782,495 filed Mar. 30, 1977.

To supplement the illumination provided by such ambient systems, light fixtures for horizontal or wall task surfaces are desirable. However, as in any office interior, flexibility of use is of the utmost importance. Moreover, since many task planes project from or are supported by the interior partitions or screens, or in rooms such as conference rooms, the task planes may actually be on the surface of the screens themselves, it is important that the supplemental light source be provided from a fixture which is readily adaptable to be mounted on the partition or screen at any desired elevation to illuminate either a horizontal task surface or a wall surface.

It is also important that the fixture be mounted on the screen or wall in a manner in which the direction of light therefrom can be adjusted relatively precisely. It is additionally important that the mounting brackets for such fixture not only provide such adjustment, but also provide a safety factor so that if excessive force is exerted on the fixture, the fixture will slip and in most instances avoid damage to the fixture, partition or screen.

It is of further importance that any fixture used in office interiors comply with the four principals of good lighting. The first is that the fixture should not create any direct glare. The person using the illumination provided by the fixture should not be able to see the light source. The second principal is to maintain a ratio of light to dark of no greater than approximately 3:1. The third principal is to have sufficient light and the fourth principal is to reduce reflected glare or veiling reflections.

In addition to providing the flexibility of use and the principals of good lighting, it is also important that the fixture have sufficient adjustability to alter light characteristics for individualization and person ergonomics. The aesthetics of the fixture and its support brackets are, however, designed strongly to suggest to the user the correct or recommended position of the fixture when used at the recommended height above a work surface. Finally, it is desirable that the fixture be of simplified construction and appearance and be fully compatible with the total office system.

It is accordingly a principal object of the present invention to provide a light fixture for horizontal task or wall surfaces for office and like interiors.

Another principal object is the provision of such fixture which can provide all of the requirements or principals of good lighting.

A further important object is the provision of such light fixture which can be mounted directly on a partition or screen to illuminate a horizontal work surface, or which can be hung above a chalk or flip-chart surface on the screen or wall, or positioned over or under a painting or graphic on the wall.

Another important object is the provision of a combination of a partition or screen with furniture hanging rows of slots and a light fixture which can be supported at any desired elevation therealong.

Still another object is the provision of a light fixture and mounting brackets therefor which permit the light fixture to be mounted on the wall or on a work surface and which provide precise angular incremental adjustment.

Yet another object is the provision of such fixture wherein the adjustment is designed to slip if excessive force is exerted on the fixture to avoid damage to the fixture of the partition or screen on which it is mounted.

It is also a principal object of the present invention to provide a light fixture for office interior task surfaces wherein reflected glare or veiling reflections can be readily reduced.

Another object is the provision of a highly flexible interior light fixture of simplified design, appearance, and construction.

These and other objects and advantages of the invention will become apparent as the following description proceeds.

To the accomplishment of the foregoing and related ends, the invention then comprises the features hereinafter fully described and particularly pointed out in the claims, the following description and the annexed drawings setting forth in detail certain illustrative embodiments of the invention, these being indicative, however, of but several of the various ways in which the principles of the invention may be employed.

In said annexed drawings:

FIG. 4 is a perspective view of another application of the present invention wherein the fixture is mounted on a frame adapted to be supported on a work surface;

FIG. 5 is an end elevation of the fixture of FIG. 4;

FIG. 6 is an enlarged end elevation of the fixture of FIG. 4;

FIG. 7 is a transverse sectional view through the housing of the fixture of the present invention; and FIG. 8 is a broken perspective of another form of mounting the fixture of the present invention.

Figure 1:
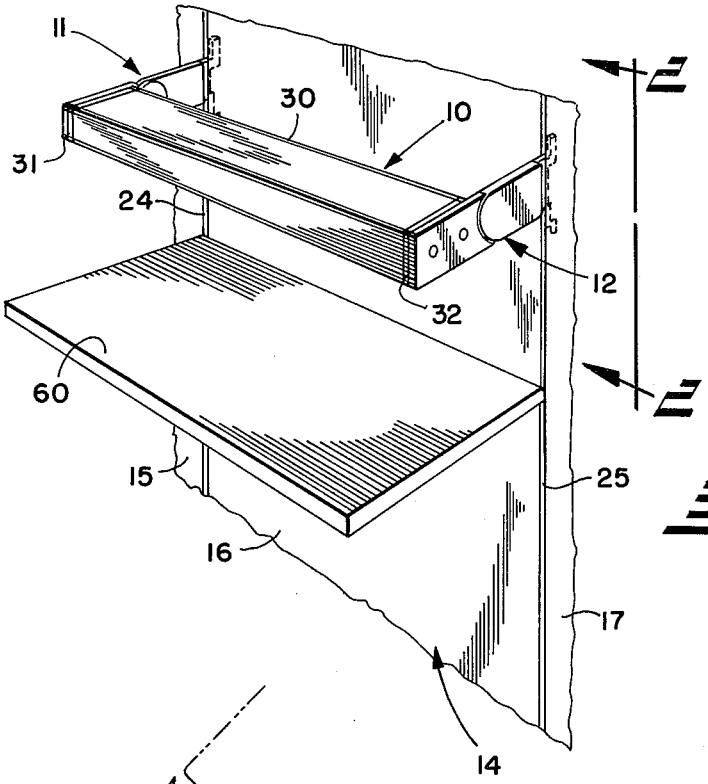
FIG. 1 is a broken perspective illustrating a light fixture in accordance with the present invention mounted on a partition or screen above a horizontal work surface or task plane.
Figure 2:
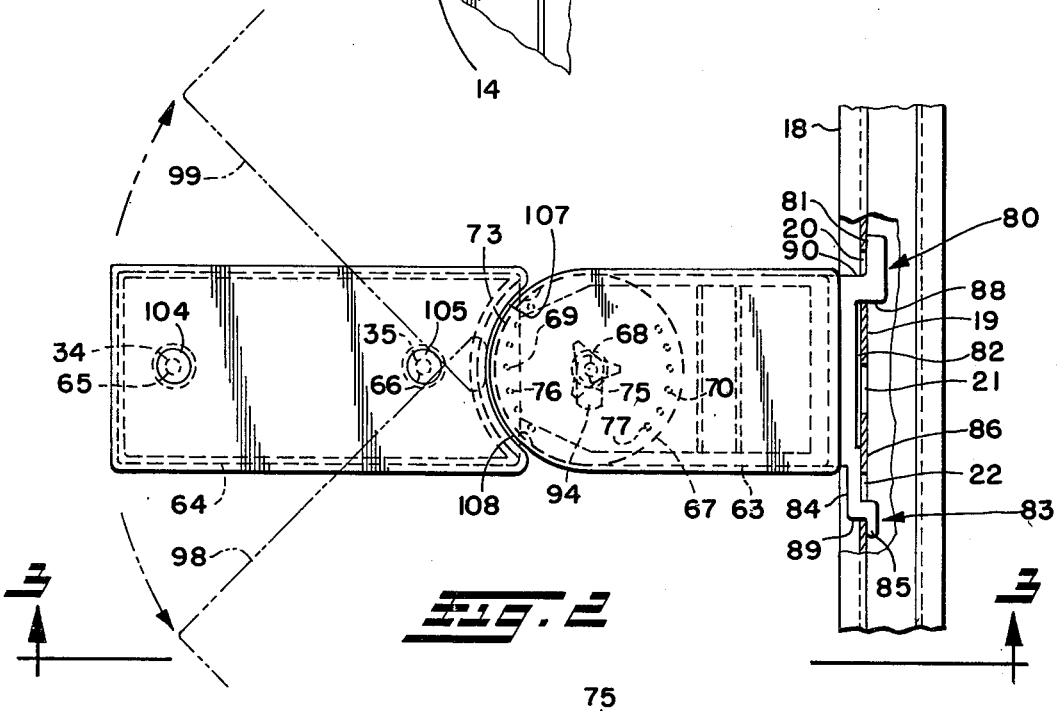
FIG. 2 is an enlarged end elevation of the fixture taken from the line 2-2 of FIG. 1 with the partition broken away and in section illustrating one of the vertical rows of slots therein.
Figure 3:
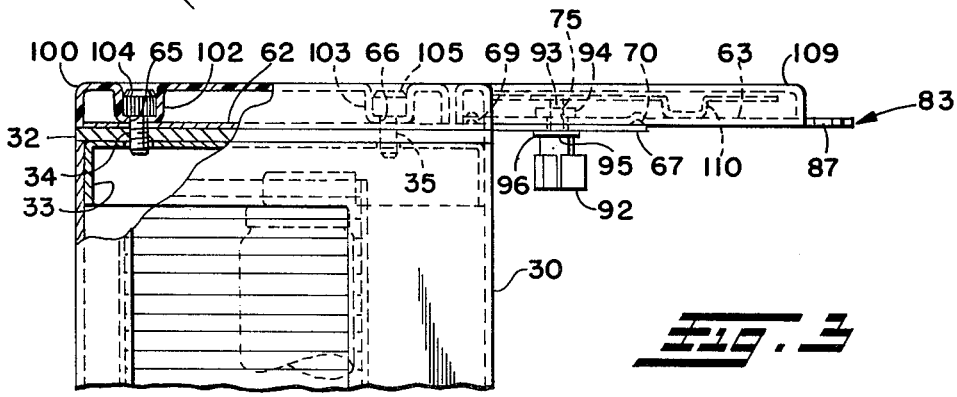
FIG. 3 is a fragmentary bottom plan view of the end of the fixture and its mounting bracket as seen from line 3—3 of FIG. 2.

Referring first to FIGS. 1, 2 and 3, there is illustrated a light fixture 10 supported between mounting bracket assemblies 11 and 12 which in turn mount the fixture on the face of an interior partition or screen shown generally at 14. Screens are normally referred to as partitions which do not extend the full height floor to ceiling while partitions or movable walls do. The partition or screen may comprise interconnected panels seen at 15, 16 and 17.

As seen more clearly in the aforementioned Raith et al U.S. Pat. No. 3,886,698, issued June 3, 1975, each panel may have recessed from the face 18 thereof a laterally extending edge flange 19 parallel to the face. In each of the edge flanges, there is a vertical row of vertically elongated equally spaced slots, three slots of one row being shown in FIG. 2 at 20, 21 and 22. The slots normally extend the fully height of the partition or screen. The vertical row of slots is shown somewhat diagrammatically in FIG. 1 at 24 and 25 at each edge of the panel 16.

The fixture 10 as seen in FIGS. 3 and 7 comprises a rectangular elongated housing 30. The housing may be of 20 gauge steel, for example, the exterior being free from knockouts, weld marks, or other blemishes. Each end of the housing is enclosed by an end plate seen at 31 and 32 which is the same rectangular configuration as the transverse sectional configuration of the housing. Such plates may be welded to thinner flanged plates 33 fitted within housing 30. The walls formed by the end plates are each provided with two tapped apertures indicated at 34 and 35 which are equally spaced from the top and bottom edges of the housing and end plates. Accordingly, a line through such apertures is parallel to and centered with respect to the top and bottom edges of the rectangular housing.

As seen in FIG. 7, the housing includes a bottom opening 37 coextensive with the housing which is formed at its rear edge by a rebent edge 38 of the bottom wall 39 of the housing 30 and at its forward edge by an upwardly inwardly inclined edge 40. A three-wire cord enters the housing as indicated at 41 through a strain relief 42. The rear wall of the housing may also be provided with a convenience outlet as seen at 43 and the bottom wall 39 is provided with an on-off rocker switch 44. The fixture includes a ballast 46, the front lower wall of which is inclined as seen at 47 to form an acute angle with the bottom wall 39. The lamp 49 is mounted between projecting receptacles 50.

A lens seen at 52 is secured over the opening 37 with the rear edge being in the notch provided by the angle 47 and the bottom wall 39. The front edge is supported on the inclined edge 40 of the housing and held in place by retainers 53 secured by fasteners 54. The retainers each include a V-shape end 55, the outer leg of which is adapted to bear against the interior edge of the lens and maintain the same in place. The lens 52 is thus supported recessed from the bottom edge or wall of the housing. Moreover, the lens may be either a prismatic lens or a parabolic louver such as are available from Lightolier. A prismatic lens comprises a series of adjacent parallel triangular prisms extending fore and aft of the fixture which disperse the light rays from the lamp laterally or in the direction of the axis of the lamp. When used as a wall mounted unit as seen in FIGS. 1–3 or in FIG. 8, the prismatic lens is preferred since it is designed primarily to reduce veiling reflections. However, in the table mounted unit as seen in FIGS. 4, 5 and 6, the parabolic or wedge-shaped louver, designed primarily to reduce direct glare, is preferred. However, the lens and louver may be used interchangeably.

Referring back to FIGS. 1–3, it will be seen that the fixture 10, supported by the bracket assemblies 11 and 12 from the screen or partition 14 may be mounted directly above a work surface or task plane 60 projecting from the wall. The fixture is mounted by means of such bracket assemblies each of which are a mirror image of the other. Accordingly, only the bracket assembly 12 will be described in detail. Such assembly includes a fixture bracket plate 62 and a panel bracket plate 63, pivotally interconnected. The bracket plate 62 includes a rectangular portion 64 which has two apertures therein as seen at 65 and 66. Such apertures correspond to and are axially aligned with the apertures 34 and 35 in the end caps of the fixture. The rectangular portion 64 is of the same rectangular profile configuration of the housing and thus the end plates of the fixture.

Projecting from the center of the rear edge of the plate 62 is a circular projection 67 which includes a center aperture 68 which is aligned with the apertures 65 and 66. The plate 62 also includes two outwardly extending detents seen at 69 and 70. Such detents are also aligned with the apertures 65, 66 and 68 and both detents are equidistant from the aperture 68. The detent 69 is actually within the rectangular portion of the plate since the circular portion 67 has a radius which intersects the rear edge of the rectangular portion.

The panel bracket plate 63 is essentially rectangular but the projecting front edge thereof is circular as indicated at 73, such edge having the same radius as the circular projection 67. The panel bracket plate also includes an aperture 75 which is in the center of the circle of the circular projection 73. The panel bracket plate further includes a series of indentations indicated at 76 on one side of the hole 75 and another series indicated at 77 on the opposite side. Such indentations are equally radially spaced from the hole 75 and are arranged at 15° increments. The indentations cooperate with the detents 69 and 70. Each series of indentations includes a total of 7, each arranged symmetrically at 15° intervals on the opposite sides of the center indentations which correspond to the detents when the plates are aligned as in FIG. 2.

The inner edge of the panel bracket plate 63 includes an inwardly and upwardly projecting hook 80, with the interior edge 81 of the hook being offset from the edge 82 of the plate slightly more than the thickness of the flange 19. The lower inner edge of the plate is provided with a hook 83. The hook 83 includes an initially downwardly extending portion 84 and a rearwardly offset tip 85. The rear edge of the downwardly extending portion 84 is offset slightly rearwardly of the edge 82 as seen at 86. The hooks present two horizontal edges seen at 88 and 89 which are spaced apart the same distance as the bottom edge of the slots 20 and 22.

The bracket can readily be installed in the row of slots by tilting the bracket upwardly and inserting the hook 80 in the top slot. The bracket is lifted until the upper edge of the slot 20 engages the top edge of the plate as seen at 90 with the upwardly projecting portion of the hook behind the flange 19. The bracket is then pivoted downwardly until the projecting offset tip 85 of the hook 83 passes through the slot 22 with the offset or heel 86 bearing against the face of the flange. The entire bracket in such horizontal position is then slid downwardly to be seated as shown. The tolerances in the bracket hooks are such that the bracket may have to be tapped into place, as for example, by a rubber mallet. When in position, there will be no looseness between the bracket and panel. The projecting ends of the hooks will bear against the interior of the flange while the heel of the hook 83 bears against the exterior of the flange. The horizontal edges 88 and 89 of the hooks will bear against the top edges of the respective slots. The bracket can readily be moved from the panel by sliding it upwardly and then tilting it outwardly. Again, a slight tap may be required to dislodge the bracket.

Adjustably to secure the two plates of the bracket assembly together there is provided a thumb knob 92 which includes a threaded stud 93 which projects through aperture 68 and is threaded into nut 94 secured to the opposite side of the plate 63. The nut 94 is preferably of a small weld plate type having a flanged tapped aperture therein projecting through the aperture 75 and spot welded to the plate 63. The thumb knob 92 includes a shoulder 95 and a washer 96 is situated between the shoulder and the circular projection 67 of the plate 62.

When the thumb knob is tightened, the two plates 62 and 63 are pressed together with the detents 69 and 70 fitting within the indentations in the plate 63. Thus the fixture may be readily adjusted from the angular inclination seen at 98 in FIG. 2 to the angular inclination seen at 99 in 15° increments. If, for example, someone should lean on the housing of the fixture or it should be struck by an object, the clamping pressure obtained by the thumb knobs is not sufficient to preclude the plates from slipping, thus avoiding damage to the fixture, and more particularly, to the panel to which it is secured.

The plate 62 is provided with a plastic cover 100 having recesses 102 and 103 therein accommodating the fasteners 104 and 105, respectively. Such fasteners are threaded into the tapped apertures 34 and 35 in the end plate 32 and secure both the plastic cover and the fixture bracket plate 62 together and to the end plate. The plastic cover is provided with a circular end wall seen at 107 which accommodates the circular end wall 108 of the plastic cover 109 on the panel bracket plate 63. The exterior of the panel bracket plate is provided with a U-shaped flange support 110, the legs of which are bent to lay parallel to and spaced from the plane of the plate 63. The bight portion of the support may be spot welded to the plate and the plastic cover may be secured to the spread legs of the support by double-sided adhesive strips. Both plastic covers confine the peripheral edges of the plates so that the entire exposed portion of the bracket assembly with the exception of the interior of the plate 63 has the appearance and warmth of molded plastic. The plastic cover 100 is, of course, held in place by the fasteners 104 and 105.

Referring now to FIGS. 4, 5 and 6, it will be seen that the same fixture 10 using the same fixture bracket plate 62 and the same plastic cover 100 may be used as a free-standing light for illuminating a task surface 115. The support or base for the fixture includes a bottom weighted plate 116 having two upwardly projecting arms at the rear ends thereof as seen at 117 and 118. The arms and base are formed from metal plates having plastic covers, each arm being forced of a plate having the profile configuration seen at 120 in FIG. 6. The plate includes a top inclined edge 121 which terminates in circular edge 122 having the same radius as the circular projection 67 of the fixture bracket plate 62. The circular edge 122 thus projects forwardly of the front edge 124 of the plate 120. The top of the plate is provided with an aperture as seen at 126 in the center of the circular edge 122. A weld nut having a flanged tapped aperture therein is spot welded to the exterior of the plate as seen at 127. The exterior of the circular projection 67 of the plate 62 is provided with the dimples or detents diametrically opposite the center hole therein which cooperate with the series of indentations on the inside of the plate 120 as shown at 129. The thumb knob 92 is employed adjustably to clamp the plates together in the same manner as in FIGS. 2 and 3. A plastic cover 130 extending from and enclosing the exterior of the plates 120 is adhesively secured to the plate 120 by double-sided adhesive strips, for example, on the spread legs of the supports seen at 131 and 132, the center offset webs or bight portions of which are spot welded to the plate 120.

It is noted that the indentations 129 are symmetrically arranged with respect to the center aperture 126 about a line parallel to the top inclined edge 121 of the plate 120. In this manner, the fixture can be adjusted 45° on either side of the center line which is parallel to the top edge. The visual conformity between the top edge of the plate 120 or the arm 118 suggests to the user the recommended angular position for the light on the work surface 115. In such position, the band of veiling reflections from the lamp will be at the rear of the task surface and not in a position which would normally create a problem for the user. As indicated in FIG. 4, the louver, discussed above, seen at 134 is employed with the fixture to avoid direct glare. Even though the aesthetics of the fixture and bracket are designed strongly to suggest to the user the correct or recommended position of the fixture, it will be appreciated that the fixture has a relatively wide range of adjustment to alter light characteristics for the individual involved.

With the embodiment of either FIGS. 1 or 4, it will be appreciated that the fixture 10 can readily be removed from its supporting brackets and turned upside down so that the light from the fixture projects upwardly. Accordingly, instead of illuminating the task surface 115 in FIG. 4, the fixture can be inverted with respect to the stand to illuminate a wall behind the task surface. The same is true with the FIG. 1 embodiment. The light fixture may be positioned over a flip chart or graphic to illuminate the same from the top or the fixture may be inverted with respect to its support brackets to illuminate a graphic or chart from the bottom.

Referring now to FIG. 8, there is illustrated the same fixture 10 illuminating task surface 60 projecting from the wall 14. In such embodiment, the fixture 10 is supported on the underside of a shelf unit shown generally at 140. The shelf unit may be supported from the partition by the hanging system seen more clearly in the aforementioned Raith et al U.S. Pat. No. 3,886,698. To support such fixture in the manner indicated, there is employed two L-shaped brackets seen at 141 and 142, the upper shorter leg of each being provided with slotted apertures extending in the direction of the leg by means of which the bracket can be fastened to the underside of the shelf unit and adjusted to be flush with the outside edge thereof. The major downwardly extending plate or leg of each bracket is provided with two apertures 144 and 145, the former being in the form of a downwardly extending arcuate slot struck from the latter. The top edge of the apertures are horizontally aligned. Suitable fasteners extend through such apertures, through the tapped apertures 34 and 35 in the end plates of the fixture, and may thus be secured in place. In this manner, the fixture may pivot about the rear aperture 145. The arcuate extent of the slot 144 may provide approximately 15° of pivot for the fixture about the aperture 145. The brackets 141 and 142 may be reversed so that the slot 144 is in the back. In this manner, the fixture may be pivoted down to the rear 15° or down to the front 15° for a total range of adjustment of 30°. Additional adjustment ranges can be provided by simply changing the length of the arcuate slot.

If desired, an appearance cover may be positioned over the front of the fixture beneath the shelf unit 140.

It can now be seen that there is provided a light fixture for use in office and like interiors which may be mounted on a stand, or directly or indirectly on screens or partitions at any desired elevation, and providing a wide range of angular adjustment.

We, therefore, particularly point out and distinctly claim as our invention:

1. In combination, an interior partition including panels having vertical rows of slots therein, a light fixture having an elongated housing, and bracket means at each end of said housing, each said bracket means at each end of said housing including two pivotally connected plates for angular adjustment of said housing, and means releasably to secure each said bracket means to one of said rows of slots whereby said fixture may be supported on said partition at substantially any elevation as determined by the slots of said rows.

2. The combination of claim 1 wherein said vertical rows of slots are at one edge of each panel, and said fixture is the same length as the horizontal distance between the vertical row of slots as the edge of a single panel.

3. The combination set forth in claim 1 wherein one of said plates is secured to the end of said housing and includes a rearwardly offset circular projection with a pivot hole in the center thereof.

4. The combination set forth in claim 3 wherein the other of said plates includes a circular forward edge of the same radius as said projection, a threaded hole in the center of said edge, and a clamp extending through said pivot hole and into said threaded hole releasably to secure said plates together with the circular edge and projection aligned.

5. The combination set forth in claim 3 including means releasably pivotally to clamp said plates together through said pivot hole.

6. The combination set forth in claim 5 including incrementally arranged detent means between said plates to permit incremental angular adjustment of said one plate and thus said fixture with respect to the other of said plates.

7. The combination set forth in claim 6 wherein said means releasably pivotally to clamp said plates together comprises a thumb knob, the clamping pressure of which is insufficient to preclude slippage between said plates in the event excessive force is exerted on said fixture.

8. The combination as set forth in claim 3 wherein the other of said plates includes a circular forward edge, and pivot means interconnecting said plates through said pivot hole with the circular forward edge and said offset projection aligned.

9. The combination set forth in claim 8 including plastic covers secured to said plates, the cover on said one of said plates including a circular recess accommodating the cover on the other of said plates.

10. The combination set forth in claim 7 wherein one of said plates is connected to said housing and the other of said plates includes oppositely vertically directed hooks adapted releasably to secure said other of said plates in one of said rows of slots.

11. The combination set forth in claim 10 wherein said slots are in a flange, the lower of said hooks including an edge adapted to bear against the face of said flange and a rearwardly offset projection including an edge adapted to bear against the interior of said flange when said other of said plates is inserted in a row of slots.

12. The combination set forth in claim 11 wherein the top and bottom edges of said other of said plates project horizontally from said panel when inserted in a row of slots.

13. A light fixture having an elongated rectangular housing, brackets secured to the ends of said housing, each including a rearwardly offset pivot, support means for each pivot, and releasable clamp means between each support means and pivot to adjust the angular inclination of said housing, the clamping pressure of which is insufficient to preclude slippage between each said support means and pivot in the event excessive force is exerted on said fixture.

14. A fixture as set forth in claim 13 wherein each bracket includes a rearwardly extending circular projection with a pivot hole in the center thereof.

15. A fixture as set forth in claim 14 wherein said support means comprises a stand having upwardly extending arms, each arm having a forwardly extending inclined offset with a circular front edge of the same radius as said circular projection.

16. A light fixture having an elongated rectangular housing, rectangular end plates for said housing, a pair of mounting holes in said end plates aligned with the top and bottom edges thereof, side support brackets for said fixture substantially coextensive with said end plates, fastener means securing said brackets to said end plates by means of said holes, and means to adjust the angular inclination of said fixture.

17. A fixture as set forth in claim 16 wherein said side support brackets include a pivot hole and an arcuate slot for two fastener means, respectively, the arc of said slot being struck from said pivot hole.

18. A fixture as set forth in claim 17 including means to support said brackets on the underside of a projection removably mounted on an interior partition.

19. A light fixture having an elongated rectangular housing, brackets secured to the ends of said housing, each including a rearwardly offset pivot, support means for each pivot, and releasable clamp means between each support means and pivot to adjust the angular inclination of said housing, each bracket including a rearwardly extending circular projection with a pivot hole in the center thereof, and said support means comprising a stand having upwardly extending arms, each arm having a forwardly extending inclined offset with a circular front edge of the same radius of said circular projection.

20. A fixture as set forth in claim 19 including means releasably pivotally to clamp said brackets and arms together through said pivot hole with said circular edge and projection axially aligned.

21. A fixture as set forth in claim 20 including detent means between each bracket and arm to permit incremental angular adjustment between said fixture and arms.

* * * * *